US008246010B2

(12) United States Patent
Hess

(10) Patent No.: US 8,246,010 B2
(45) Date of Patent: Aug. 21, 2012

(54) FLUID SHEAR ACTUATED HOIST BRAKE

(76) Inventor: Daniel L. Hess, Hays, KS (US)

( * ) Notice: Subject to any disclaimer, the term of this patent is extended or adjusted under 35 U.S.C. 154(b) by 577 days.

(21) Appl. No.: 12/583,021

(22) Filed: Aug. 13, 2009

(65) Prior Publication Data

US 2011/0037040 A1 Feb. 17, 2011

(51) Int. Cl.
*B66D 1/14* (2006.01)

(52) U.S. Cl. ..... 254/368; 254/278; 254/347; 254/367; 254/377; 188/71.5; 188/71.6; 188/73.34; 188/322.5; 188/266

(58) Field of Classification Search ..... 254/278, 254/346, 347, 366, 367, 368, 377; 188/71.5, 188/71.6, 73.34, 322.5, 266; 182/233
See application file for complete search history.

(56) References Cited

U.S. PATENT DOCUMENTS

| | | | | | |
|---|---|---|---|---|---|
| 3,390,748 | A | | 7/1968 | Hein et al. | |
| 3,486,588 | A | | 12/1969 | Grego | |
| 3,776,518 | A | | 12/1973 | Witwer | |
| 3,847,377 | A | * | 11/1974 | Byrd | 242/396 |
| 3,990,552 | A | * | 11/1976 | Muntjanoff | 192/12 C |
| 4,004,779 | A | * | 1/1977 | Flesburg | 254/366 |
| 4,060,159 | A | | 11/1977 | Chaney et al. | |
| 4,111,291 | A | | 9/1978 | Horstman | |
| 4,324,387 | A | * | 4/1982 | Steinhagen | 254/310 |
| 4,615,418 | A | | 10/1986 | Atwell | |
| 4,674,608 | A | | 6/1987 | Morris et al. | |
| 5,141,085 | A | | 8/1992 | McCormick | |
| 5,207,305 | A | | 5/1993 | Iverson | |
| 5,228,543 | A | | 7/1993 | Heidenreich | |
| 5,458,318 | A | | 10/1995 | Jussila | |
| 5,860,635 | A | * | 1/1999 | Morfitt et al. | 254/377 |
| 5,935,036 | A | * | 8/1999 | Gassmann et al. | 475/87 |
| 6,094,024 | A | | 7/2000 | Westlake | |
| 6,766,884 | B2 | | 7/2004 | Parsons et al. | |
| 7,077,245 | B2 | | 7/2006 | Kuivamaki | |
| 7,201,366 | B2 | * | 4/2007 | Sanders et al. | 254/361 |
| 2006/0183591 | A1 | | 8/2006 | Krammer et al. | |
| 2006/0192188 | A1 | * | 8/2006 | Sanders et al. | 254/361 |

* cited by examiner

*Primary Examiner* — Emmanuel M Marcelo
(74) *Attorney, Agent, or Firm* — John C. McMahon

(57) ABSTRACT

A fluid shear actuated brake mechanism includes an outer hub secured to a hoist frame, a main brake disc stack engaged between the outer hub and a hoist drum shaft, an actuator hub helically engaged with the outer hub, and an actuator disc stack engaged between the actuator hub and the shaft. The main disc stack and the actuator disc stack are immersed in a fluid. Rotation of the shaft in a load lowering direction generates fluid shear in the actuator disc stack which rotates the actuator hub in a lowering direction and advances it toward the main disc stack, compressing it and the actuator disc stack. Rotation of the shaft in an opposite load lift direction retract the actuator hub from the main disc stack.

27 Claims, 7 Drawing Sheets

Fig. 6.
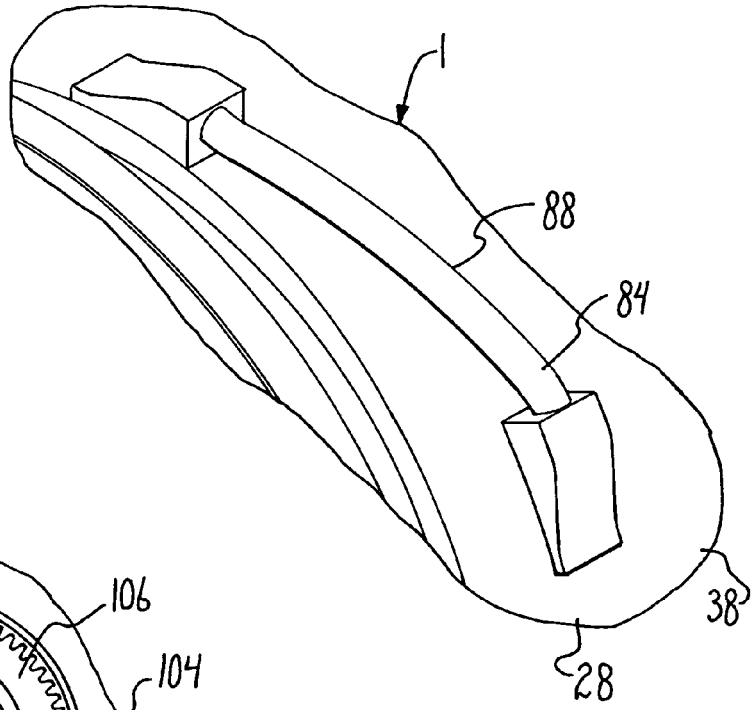
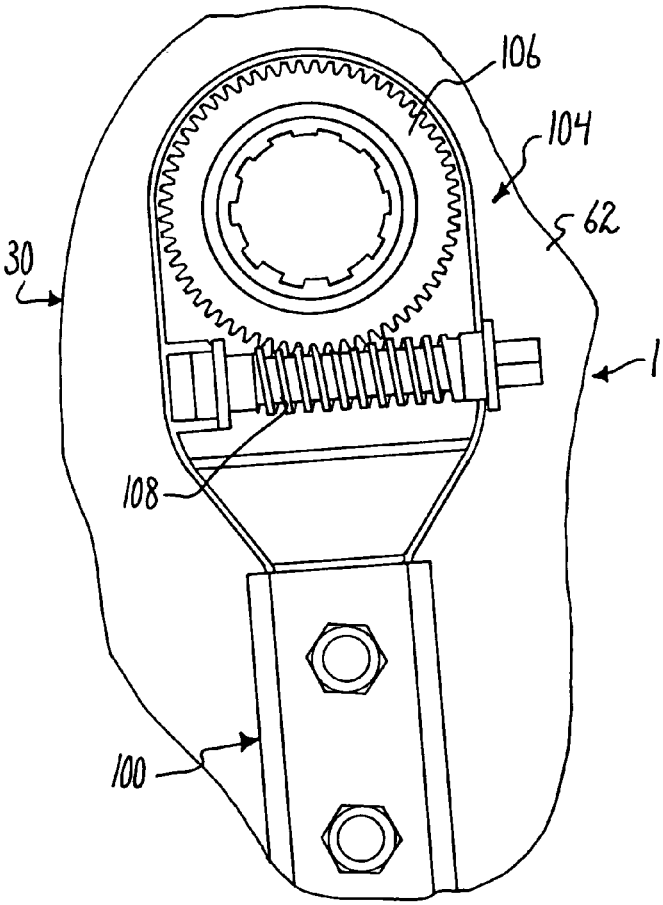
Fig. 7.

FLUID SHEAR ACTUATED HOIST BRAKE

BACKGROUND OF THE INVENTION

The present invention is broadly concerned with lifting equipment and, more particularly, with a hoist brake mechanism which is actuated by directional fluid shear to control lowering of a heavy load.

Construction and other activities involve the lifting and repositioning of heavy equipment, structural members, building materials, and the like. Hoisting apparatus typically includes a cable drum mounted on a framework, a motor to rotate the cable drum to lift the load, and a brake engaged with the drum shaft to control the lowering and stopping of the load. The hoisting apparatus may be mounted on or connected to a boom which may be swung about to a desired location for lifting or lowering of a load. During lifting, the motor is engaged with the shaft, as by a gearing and/or clutch arrangement, to rotate the shaft and lift the load. When the load reaches its maximum desired height, the brake is applied to halt rotation of the shaft, as the motor is stopped or disengaged. The brake is used to hold the load while the load is swung to a desired location. The brake is then partially released to lower the load to its new location. As the load approaches its location, the brake is tightened to slow and then stop the load, to slowly set the load down at its final location.

During a long lowering operation, the load is not allowed to simply free-fall, especially with a particularly heavy load, since the load would likely accelerate out of control. Instead, the brake is partially applied to lower the load at approximately a constant speed. Because the kinetic energy of the lowering load is converted to heat in the brake, hoisting equipment is rated on the amount of weight that can be lifted and lowered in a given amount of time, to account for the necessary dissipation of heat. The rating also factors in the horsepower of the lifting motor and the strength of the various components of the hoist equipment. The working rating of hoist mechanisms of a given design can be increased by various methods for dissipating the heat generated in lowering a load, such as by the circulation of air or fluids through the brake.

In order to increase the safety of hoist mechanisms, various methods for automatically applying the hoist brake during lowering of a load have been developed to control descent of the load. In some arrangements, the direction of rotation and sometimes the torque on the shaft are detected electronically and used to control the application of the brake. Such systems tend to be complex. In an approach disclosed in U. S. Pat. No. 3,486,588, a hoist shaft engages a helical cam through a planetary gear set which causes an actuation sleeve to compress a brake disc stack when the shaft rotates in the lowering direction of the hoist and retracts the sleeve when rotating in the lift direction to allow free rotation of the shaft. However, this is a complex arrangement involving a substantial number of components which do not directly retard rotation of the shaft.

Hoist brake arrangements are generally designed for lifting loads up to a stated upper load limit. The limit is based on the strength of the components and on the amount of braking friction that can be generated. Over time, braking friction creates wear on the brake elements, such as on stacks of rotary and fixed brake discs. If a hoist employing such a brake is typically used for lifting loads which are significantly below the upper load limit, wear often occurs on more brake elements than is necessary. However, with most hoist brake designs, there is no way to vary the number of brake elements to an optimum number for the size of the load normally lifted by the hoist.

SUMMARY OF THE INVENTION

The present invention provides an improved hoist brake mechanism which uses directional fluid shear to cause application of a main brake when a drum shaft rotates in a lowering direction to cause controlled lowering of a load and which releases the main brake when the shaft rotates in an opposite lift direction to enable substantially free rotation of the shaft during lifting.

An embodiment of the hoist brake mechanism includes a main brake mounted in an outer hub secured to a hoist frame and engaged between the outer hub and a drum shaft to retard rotation of the shaft when the main brake is axially actuated, an actuation hub helically engaging the outer hub and axially engaging the main brake when rotated in a lowering direction of the shaft, and a fluid shear arrangement fluidically engaged between the shaft and the actuation hub. Rotation of the shaft in the lowering direction causes directional fluid shear in the fluid shear arrangement which urges the actuation hub to rotate in the same lowering direction and axially engage the main brake to partially apply the main brake. Rotation of the shaft in a lift direction reverses the action by urging the actuation hub to rotate in the lift direction and axially retract from the main brake, causing it to disengage.

In an embodiment of the hoist brake mechanism, the fluid shear arrangement includes an actuator disc stack including a plurality of rotary actuator discs slidably engaged with the shaft and rotating therewith and a plurality of fixed actuator discs interleaved among the rotary actuator discs and slidably engaging the actuator hub such that the fixed actuator discs are fixed relative to the actuator hub. In an embodiment of the hoist brake mechanism, an inner hub is secured to the shaft and rotates therewith. The rotary actuator discs may include spline teeth on center openings to engage axially extending hub splines on an external surface of the inner hub, and the fixed actuator discs may include spline teeth on their outer edges to engage axial internal splines formed on the inner surface of the actuator hub.

An embodiment of the actuator hub has a radially inner helical groove formed on its external surface which is aligned with a radially outer helical groove formed on an inner surface of the outer hub. The inner and outer helical grooves form a helical bearing passage which is filled with ball bearings to provide very low frictional engagement between the outer hub and the actuator hub. The helical bearing passage includes a bearing return passage, interconnecting the ends of the bearing passage external to the outer hub, by means of which the bearings recirculate in a closed path.

The actuator disc stack, at least, is filled with a fluid, such as an hydraulic fluid or oil, whereby rotation of the rotary actuator discs in close proximity with the fixed actuator discs generates fluid shear, which increases as the spacing among the discs decreases. The fluid shear has a direction, which tends to oppose rotation of the rotary actuator discs relative to the fixed actuator discs. Because the actuator hub is substantially freely rotatable with respect to the outer hub, fluid shear generated in the actuator disc stack urges the actuator hub to rotate in the same direction as the hoist shaft. Rotation of the actuator hub continues in the lowering direction of the shaft until the actuator hub meets axial resistance by engagement with the main brake. In the lift direction of shaft rotation, the actuator hub is axially retracted from the main brake. As will be detailed below, retraction of the actuator hub from the main brake causes expansion of the actuator disc stack, thereby reducing the fluid shear between the rotary and fixed actuator discs. Rotation of the actuator hub in the lift direct direction continues until an equilibrium is established between the reduced fluid shear and the low friction of the bearings in the bearing passage.

In an embodiment of the hoist brake mechanism, the main brake is formed by a main disc stack including a plurality of rotary main discs interleaved among a plurality of fixed main discs. The rotary main discs are slidable relative to the inner hub, such as by spline teeth on center openings of the rotary main discs and axial splines on the inner hub. The fixed main discs are slidably engaged with the outer hub, as by external spline teeth on the outer edges of the fixed main discs and axial splines on an inner surface of the outer hub. Compression of the main disc stack causes a drag or braking effect to retard and/or stop rotation of the shaft. Although it is foreseen that the main disc stack could be dry, relying only on friction among the discs for braking, an embodiment of the main disc stack is immersed in a fluid similar to that of the actuator disc stack. By this means an increasing amount of braking occurs as a result of fluid shear generated by relative rotation of the rotary and fixed main discs as the main disc stack is compressed, and additional braking occurs by surface friction when the rotary and fixed discs touch because of strong axial compression.

In an embodiment of the hoist brake mechanism, an actuator or spacer sleeve is positioned on the inner hub between the main disc stack and the actuator disc stack. The actuator sleeve has a main end adjacent the main disc stack and an actuator end adjacent the actuator disc stack. The main disc stack is positioned between the main end of the actuator sleeve and a closed end of the outer hub. The actuator disc stack is positioned between the actuator end of the actuator sleeve and a closed end of the actuator hub.

When the actuator hub is rotated in the lift direction, it axially retracts from the main disc stack, enabling the main disc stack and the actuator disc stack to axially expand. Fluid shear between adjacent sets of rotary and fixed discs urges the discs to separate from one another to thereby minimize the fluid shear therebetween. At a situation of equilibrium between diminishing fluid shear among the discs and friction among the bearings and the bearing passage, rotation of the actuator hub in the lift direction ceases, and the shaft is allowed to rotate in the lift direction with minimal resistance from the hoist brake mechanism.

When the actuator hub is rotated in the lowering direction, the closed end of the actuator hub urges the actuator disc stack against the actuator end of the actuator sleeve, thereby urging the main end of the actuator sleeve against the main disc stack. In the process, the main disc stack is axially compressed between the main end of the actuator sleeve and the closed end of the outer hub, while the actuator disc stack is axially compressed between the closed end of the actuator hub and the actuator end of the actuator sleeve. Thus, the actuator disc stack forms an assist brake section which contributes to the braking effect, along with the main disc stack.

In addition to automatic partial application of the main brake during lowering of a load, the hoist brake mechanism is provided with a manual control to enable an increased braking effect to stop lowering or lifting of a load or to decrease braking of the hoist shaft. In an embodiment of the hoist brake mechanism, a brake operating lever is secured to the actuator hub on the closed end wall to enable manual rotation of the actuator hub in the lowering direction to increase the braking effect by axial engagement of the actuator hub with the main brake or rotation of the actuator hub in the lift direction do decrease the braking effect. Manual operation of the brake operating lever may be accomplished either directly or indirectly by an arrangement of mechanical links or linkages. It is also foreseen that operation of the brake operating lever may be accomplished remotely using electrical, hydraulic, pneumatic, or similar means to selectively apply an angular force on the actuator hub.

Over time, wear on the discs of the main brake disc stack and/or the actuator disc stack can diminish the thickness of the discs. Because of this, the actuator hub would have to travel axially a longer distance from an initial starting position to achieve the same braking effect. To overcome this, an embodiment of the hoist brake mechanism provides a means of adjustment of the angular relationship between the brake operating lever and the actuator hub and, thus, provides a means of biasing or calibrating the initial position of the actuator hub for a given angular position of the brake operating lever. In one embodiment of the lever, a worm and worm wheel or spur gear arrangement is provided with the worm mounted on the lever and a spur gear secured to the closed end wall of the actuator hub. The lever adjustment arrangement can also be used to set the initial position of the actuator hub if the brake discs are replaced with thicker new discs.

A heavier load on the hoist drum places a higher torque on the shaft than a relatively lighter load, thereby having a tendency to accelerate the shaft rotation more strongly than a lighter load. This generates a higher level of fluid shear within the actuator disc stack, resulting in a stronger rotation of the actuator hub and generation of a stronger axial compression of the main disc stack to resist acceleration of the heavier load. Thus, the hoist brake mechanism is essentially self regulating over a range of load weights.

In a hoist brake mechanism which employs fluid shear to generate braking, a relatively larger number of discs creates a stronger braking force than a smaller number of discs and would be appropriate to control the lifting and lowering of a relatively heavier load. In an embodiment of the hoist brake mechanism, the configuration of the mechanism is amenable to tailoring the number of disc sets in the main brake disc stack and/or the actuator disc stack to the maximum load weight that is intended to be manipulated by the hoist mechanism. In order to compensate for variations in the length of the disc stacks, this embodiment of the hoist brake mechanism can have spacer discs added or removed as necessary to adjust the length of the overall mechanism so that the actuator hub is correctly positioned axially and angularly with respect to the fixed hub. Such an adjustment does not typically occur in the field, but in an initial setup of the hoist brake mechanism.

Various objects and advantages of the present invention will become apparent from the following description taken in conjunction with the accompanying drawings wherein are set forth, by way of illustration and example, certain embodiments of this invention.

The drawings constitute a part of this specification, include exemplary embodiments of the present invention, and illustrate various objects and features thereof.

BRIEF DESCRIPTION OF THE DRAWINGS

FIG. 6 is a greatly enlarged fragmentary perspective view of a bearing return passage of the fluid shear actuated hoist brake mechanism.

FIG. 7 is a greatly enlarged fragmentary end elevational view of a brake operating lever of the fluid shear actuated hoist brake mechanism with a portion broken away to illustrate a worm and spur gear arrangement for adjusting the angle of the lever relative to an actuator hub.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
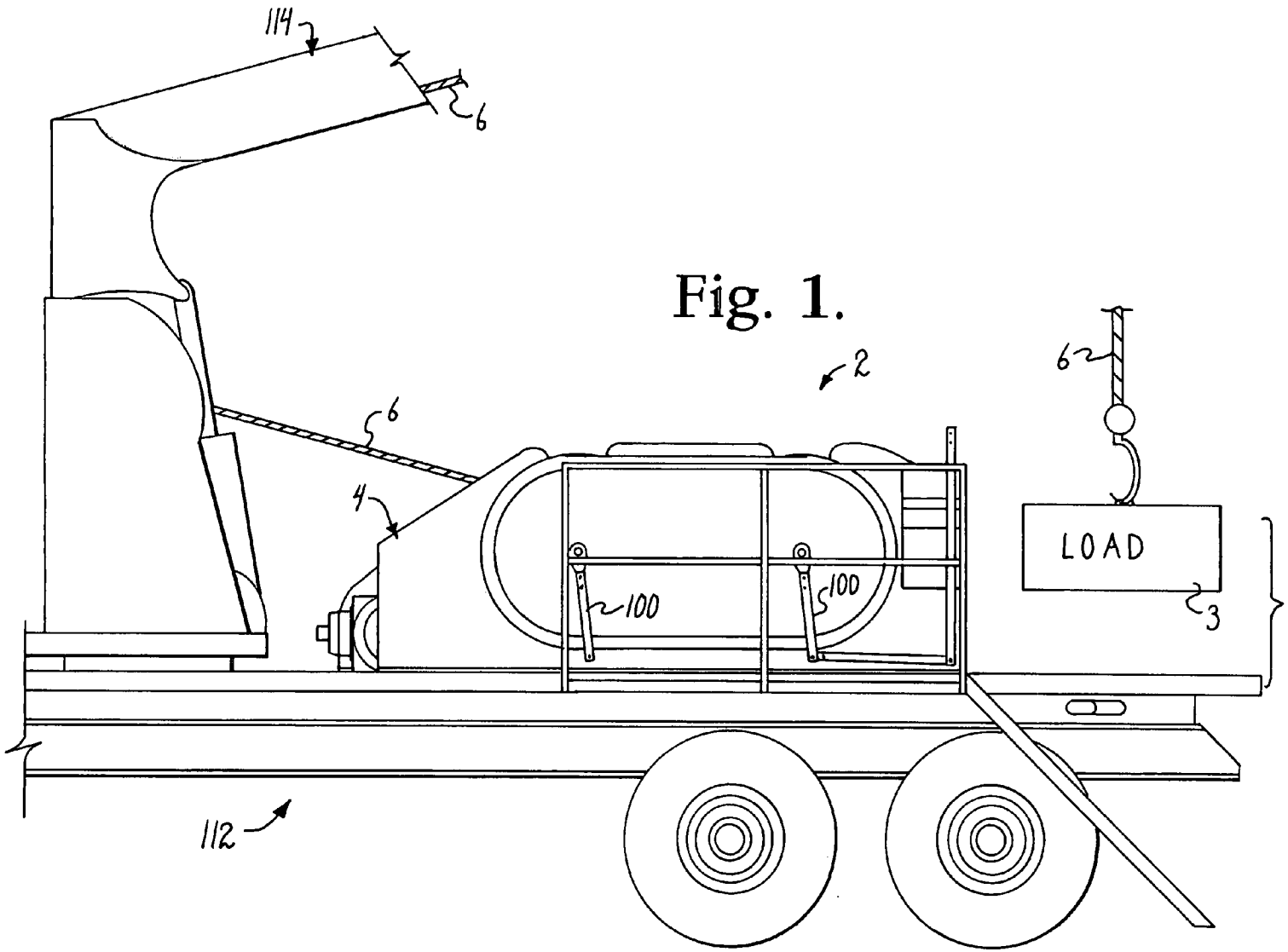
FIG. 1 is a fragmentary side elevational view of a boom truck employing a double set of cable load hoists, each hoist incorporating a fluid shear actuated hoist brake mechanism according to the present invention, and diagrammatically showing a load manipulated by the one of the hoists.
Figure 2:
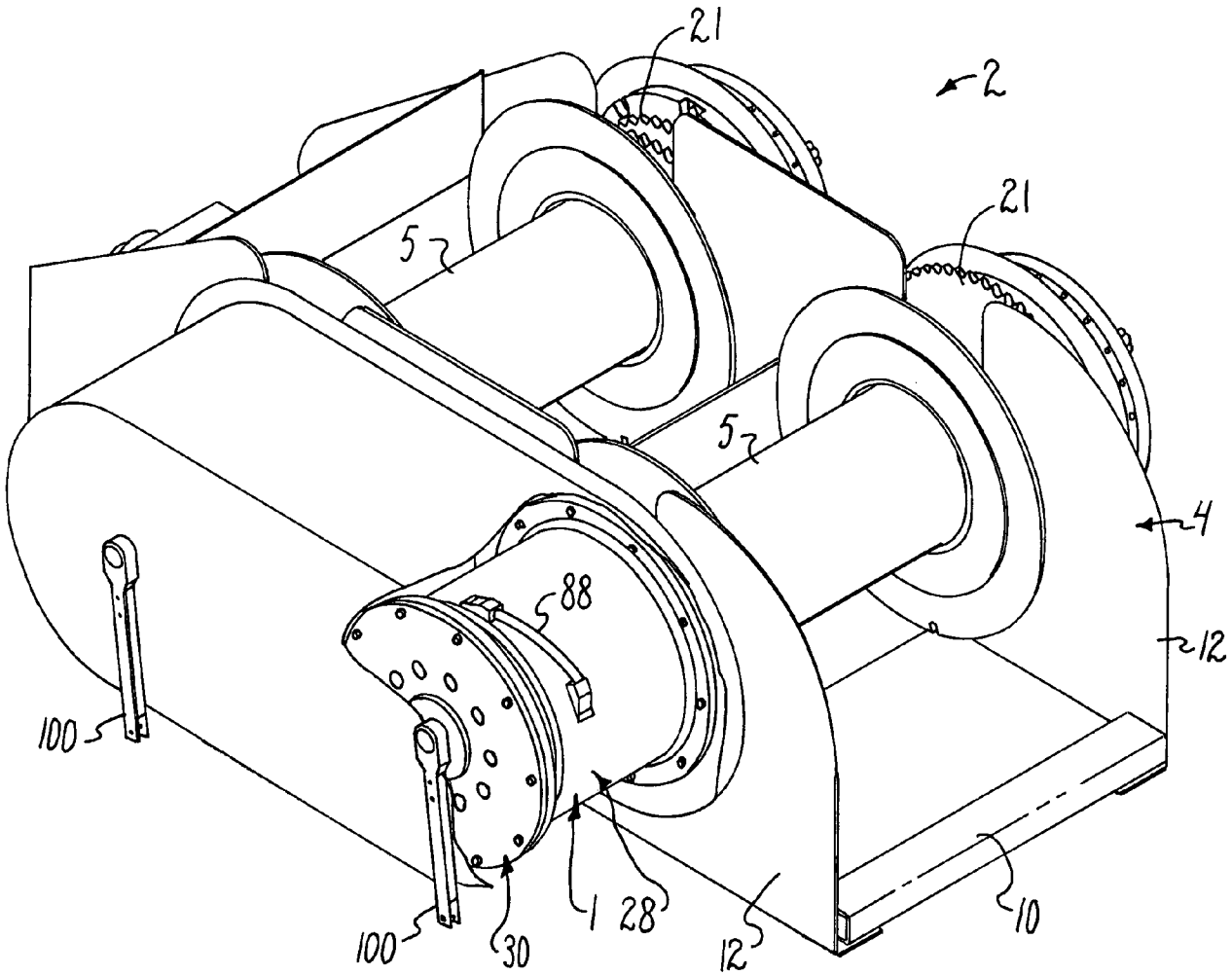
FIG. 2 is an enlarged perspective view of the double set of cable load hoists with a cover broken away to illustrate an external view of the fluid shear actuated hoist brake mechanism.

Referring to the drawings in more detail, the reference numeral 1 (FIGS. 2 and 3) generally designates an embodiment of a fluid shear actuated hoist brake mechanism according to the present invention. In general, the hoist brake mechanism 1 is used in cooperation with hoist equipment 2 to control the lifting and lowering of a load 3 (FIG. 1). The hoist equipment 2 includes a hoist framework 4 on which a cable drum 5 is rotatably mounted and on which a hoist cable 6 is wound such that rotation of the drum 5 reels in or pays out the cable 6 to thereby lift or lower the load 3.

Figure 3:
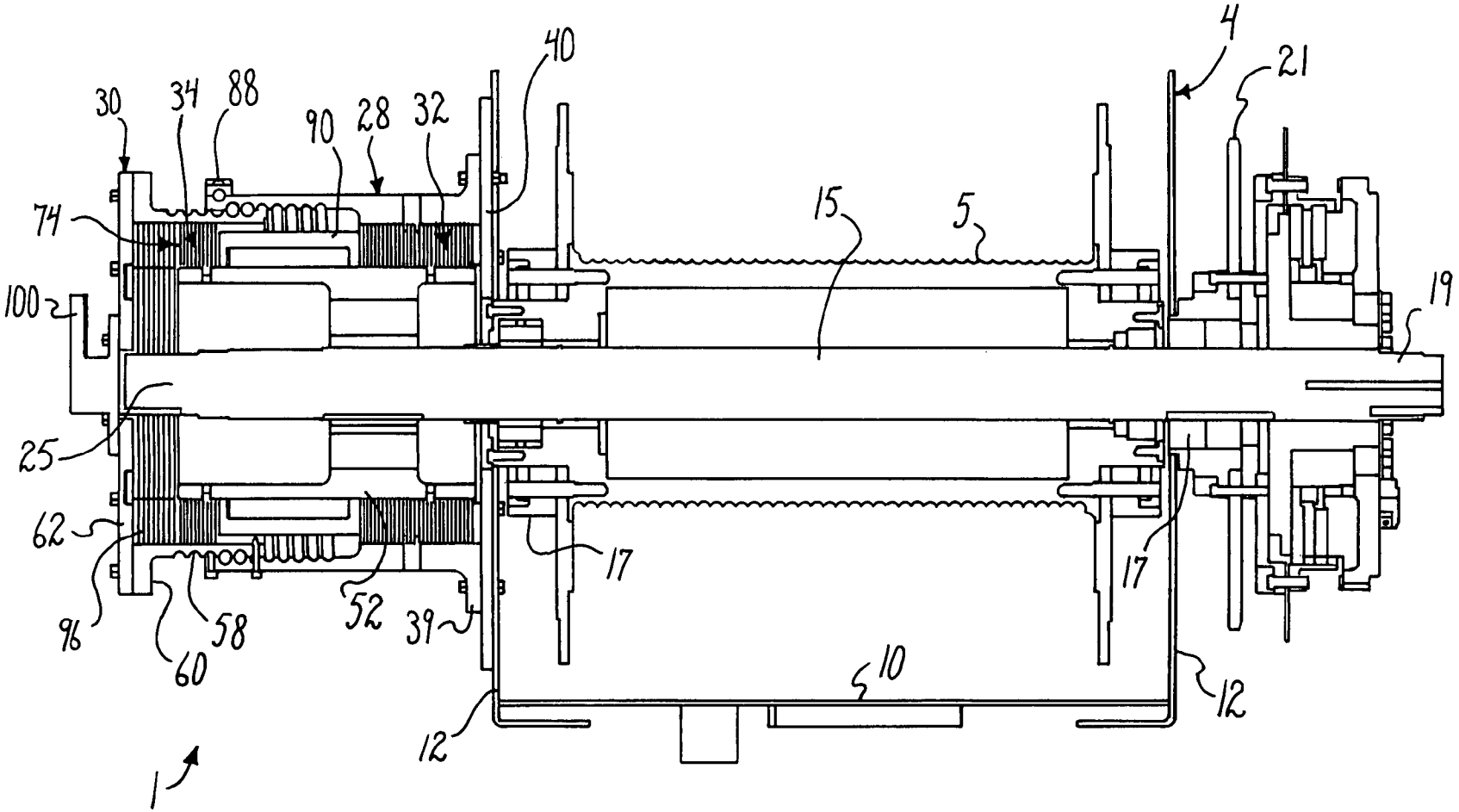
FIG. 3 is a further enlarged axial cross sectional view of a cable load hoist and illustrates internal details of an embodiment of the fluid shear actuated hoist brake mechanism.

Referring to FIG. 3, the illustrated hoist equipment 2 includes a U-shaped hoist framework 4 formed by a base panel 10 with side panels 12 upstanding therefrom. A hoist shaft 15 is rotatably supported by bearing sets 17 in the side panels 12. The cable drum 5 is secured to the shaft 15 and rotates therewith. A drive section 19 of the shaft 15 extends through one of the side panels 12 and has a drive sprocket 21 secured thereto. A motor (not shown) is engaged with the drive sprocket 21, as by a chain, transmission, and clutch (not shown) to cause rotation of the shaft 15 in a lift direction, to cause the cable drum 5 to reel in the cable 6 to lift the load 3. Conversely, the motor can be disengaged from the shaft 15 to enable the drum 5 to pay out the cable 6, to lower the load 3. A brake section 25 of the shaft 15 extends through the framework side panel 12 opposite from the drive section 19 and extends through the hoist brake mechanism 1.

The principal components of the illustrated embodiment of the hoist brake mechanism 1 include an outer hub 28 secured to one of the side panels 12 of the hoist framework 4, an actuator hub 30 helically engaged with the outer hub 28, a main brake assembly 32 engaged between the shaft 15 and the outer hub 28, and a fluid shear assembly 34 engaged between the shaft 15 and the actuator hub 30. The fluid shear assembly 34, at least, is immersed in a liquid fluid 36, although the main brake assembly 32 may also be filled with the fluid 36. The fluid 36 may be a suitable hydraulic fluid or oil, and may be routed through a heat exchanger (not shown) to dissipate heat generated by fluid shear and friction within the mechanism 1. The helical engagement of the actuator hub 30 with the outer hub 28 has a direction such that angular rotation of the actuator hub 30 relative to the outer hub 28 in the lowering direction of the shaft 15 axially advances the actuator hub 30 into the outer hub 28; conversely, rotation of the actuator hub 30 in the opposite lift direction of the shaft 15 axially retracts the actuator hub 30 from the outer hub 28.

Fluid shear within the fluid shear assembly 34 urges the actuator hub 30 to follow the direction of rotation of the shaft 15. Axial advancement of the actuator hub 30 into the outer hub 28 causes axial engagement of components of the main brake assembly 32, causing rotation of the shaft 15 in the lowering direction to be retarded. Conversely, axial retraction of the actuator hub 30 from the outer hub 28 enables axial disengagement of components of the main brake 32, enabling substantially free rotation of the shaft 15 in the lift direction.

The illustrated outer hub 28 is a cylindrical shell including a cylindrical wall 38 having an end flange 39. The cylindrical wall 38 is closed at an inner end by an end wall 40, which is secured to the end flange 39. In the illustrated embodiment of the mechanism 1, the main brake assembly 32 is formed by a plurality of stationary wear plates or fixed main discs 42 interleaved among a plurality of rotary friction discs or rotary main discs 44, which, in aggregate, combine to form a main disc stack 46. Although the illustrated fixed and rotary main discs 42 and 44 are flattened annular members or rings, they are referred to herein as "discs".

Figure 4A:
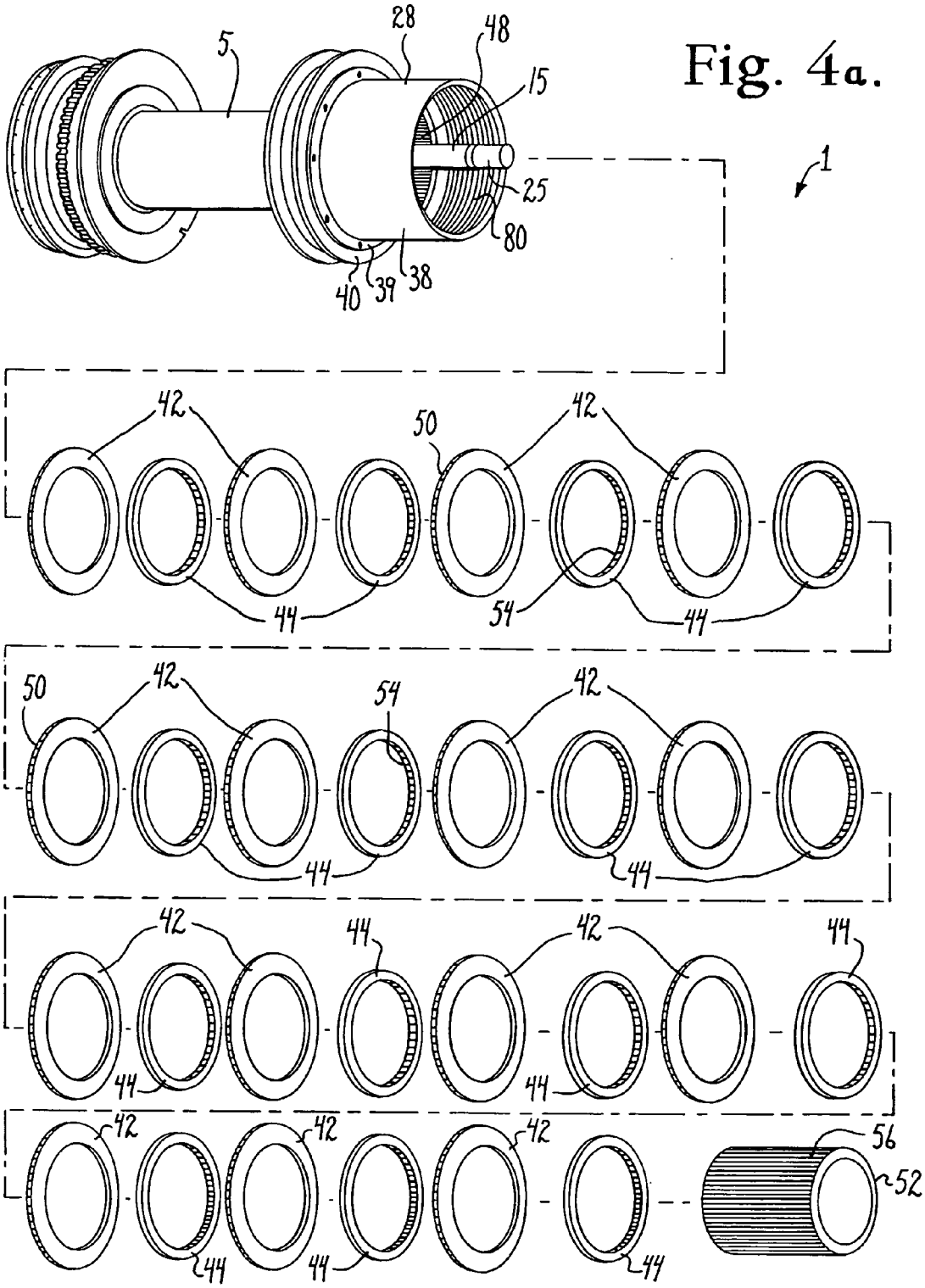
FIGS. 4*a* and 4*b* comprise an exploded perspective view of an embodiment of the fluid shear actuated hoist brake mechanism.

The fixed main discs 42 are slidably engaged with an inner surface of the cylindrical wall 38 of the outer hub 28, as by axially extending splines 48 (FIG. 4*a*) on the inner surface of the cylindrical wall 38 and complementary spline teeth 50 on outer edges of the fixed main discs 42. Thus, the fixed main discs 42 are angularly fixed but axially movable with respect to the outer hub 28. The rotary main discs 44 are slidably engaged with the shaft 15 such that they rotate with the shaft 15. In the illustrated mechanism 1, an inner hub 52 is secured to the shaft 15 and rotates therewith. The illustrated rotary main discs 44 are provided with inner spline teeth 54 which slidably engage axially extending splines 56 on the inner hub 52.

Although it is foreseen that the main brake assembly 32 could be a dry brake arrangement, the illustrated assembly 32 is filled with the fluid 36. Thus, fluid shear is generated in the fluid 36 between adjacent sets of fixed and rotary main discs 42 and 44 which increases as the axial spacing between adjacent discs diminishes. The fluid shear creates a drag to rotation of the shaft 15 which increases as the main disc stack 46 is compressed. The drag is maximized when the discs 42 and 44 are axially urged into surface-to-surface frictional contact. Axial compression of the main disc stack 46 in the mechanism 1 is accomplished by axial movement the actuator hub 30 toward the main brake 32. When the actuator hub 30 is retracted from the main brake 32, the fixed and rotary main discs 42 and 44 are allowed to expand. Fluid shear tends to push adjacent discs 42 and 44 away from one another until fluid shear is minimized, allowing the shaft 15 to rotate substantially freely. Although the illustrated embodiment of the main brake assembly 32 incorporates the fixed and rotary main discs 42 and 44, it is foreseen that other configurations of a main brake arrangement could be devised which incorporate other types of axially engaging and disengaging brake components.

The actuator hub 30 is formed by a cylindrical wall 58 having an outer end flange 60. The cylindrical wall 55 is closed at an outer end by an outer end wall 62 which is secured to the end flange 60. The fluid shear assembly 34 is positioned within the actuator hub 30 and is engaged between the actuator hub cylindrical wall 58 and the brake section 25 of the hoist shaft 15. In the illustrated embodiment of the hoist brake mechanism 1, the fluid shear assembly 34 includes a plurality of fixed actuator friction plates or plates 64 interleaved among a plurality of rotary actuator friction discs or discs 66. The illustrated actuator discs 64 and 66 are similar to the main discs 42 and 44 in that they are actually flattened rings; however, the fixed and rotary actuator members 64 and 66 will be referred to herein as "discs".

Figure 4B:
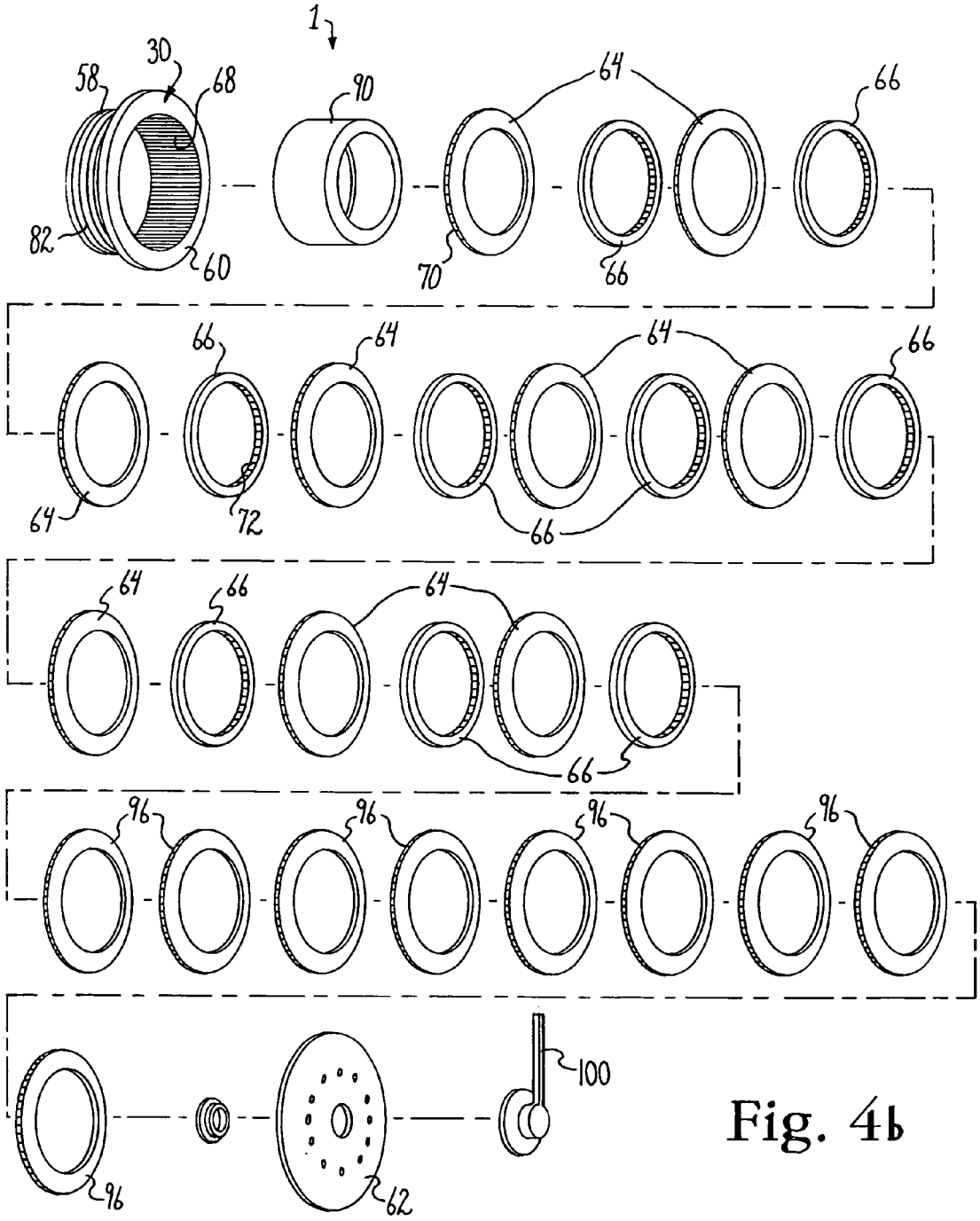

The fixed actuator discs 64 are slidably engaged with the cylindrical wall 58 of the actuator hub 30 in such a manner as to be angularly fixed relative to the wall 58. In the illustrated mechanism 1, an inner surface of the wall 58 is provided with axially extending splines 68 (FIG. 4*b*), and outer edges of the fixed actuator discs 64 are provided with spline teeth 70 which slidably engage the splines 64. Similarly, the rotary actuator discs 66 slidably engage the shaft 15 by way of the inner hub 52 and rotate with the shaft 15. The rotary actuator discs 66 are provided with spline teeth 72 which slidably engage the splines 56 of the inner hub 52.

The fixed and rotary actuator discs 64 and 66 cooperate to form an actuator disc stack 74 which functions as the fluid shear assembly 34. The actuator disc stack 74 is immersed in the fluid 36 such that fluid shear is generated in the fluid 36 between adjacent sets of the fixed and rotary actuator discs 64 and 66 in response to relative rotation thereof. The fluid shear increases as the spacing between the fixed and rotary actuator discs 64 and 66 decreases and decreases when the discs 64 and 66 spread apart. The angular direction of the fluid shear is in the same direction as the direction of rotation of the shaft 15, thus urging actuator hub 30 in the same direction as the shaft 15. The fluid shear in the actuator disc stack 74 not only causes rotation of the actuator hub 30 but also has a braking effect on the shaft 15, as will be described below. Compression of the disc stack 74 increases fluid shear between the fixed and rotary actuator discs 64 and 66, thereby retarding rotation of the shaft 15. Surface friction by surface to surface contact of adjacent discs 64 and 66 causes further braking effect.

The actuator hub 30 is helically engaged with the outer hub 28. In the illustrated mechanism 1, an outer helical groove 80 is formed into an inner surface of the cylindrical wall 38 of the outer hub 28. A complementary inner helical groove 82 is formed on an outer surface of the cylindrical wall 58 of the actuator hub 30. The actuator hub 30 is positioned in the outer hub to align the grooves 80 and 82 to form a helical bearing passage 84 which is filled with ball bearings 86. Opposite ends of the bearing passage 84 are connected by a return passage 88 (FIGS. 2, 3, 5, and 7) which allows the bearings 86 to recirculate through the closed bearing passage 84 as the actuator hub 30 rotates into and out of the outer hub 28. The bearing passage 84 may be filled with the fluid 36 to lubricate contact of the bearings 86 with one another and with surfaces forming the bearing passage 84. The bearings 86, in cooperation with the grooves 80 and 82, provide very low frictional engagement of the actuator hub 30 with the outer hub 28.

Figure 5:
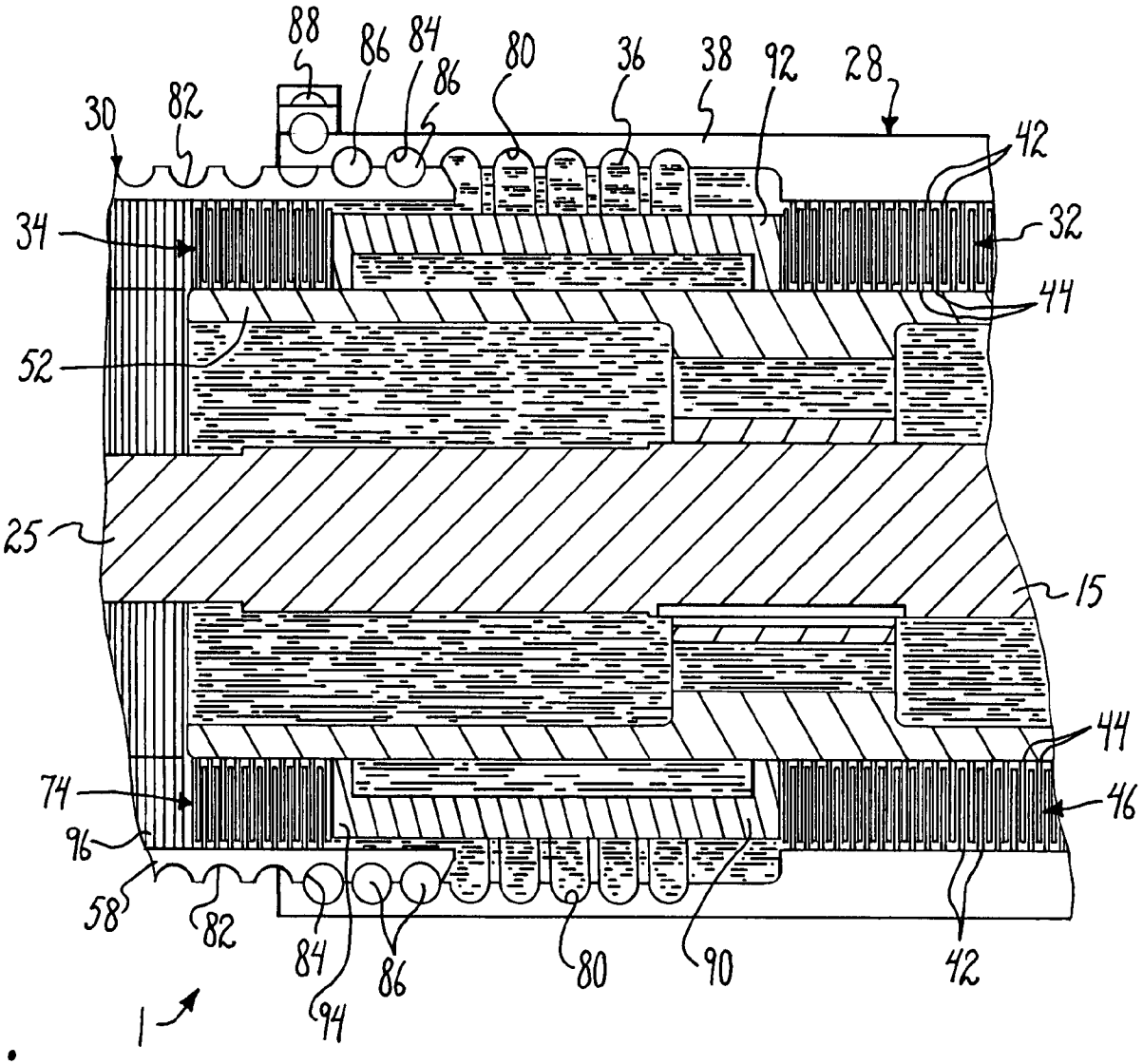
FIG. 5 is a greatly enlarged fragmentary axial cross sectional view of the fluid shear actuated hoist brake mechanism.

Rotation of the actuator hub 30 in the lowering direction of the shaft 15 axially advances the actuator 30 toward the main brake assembly 32 to thereby compress the main disc stack 46. In the illustrated mechanism 1, a cylindrical actuator sleeve 90 is positioned on the inner hub 52 between the actuator disc stack 74 and the main disc stack 46. Referring to FIGS. 3 and 5, the main disc stack 46 is positioned between a main end 92 of the sleeve 90 and the outer hub end wall 40. The actuator disc stack 74 is positioned between an actuator end 94 of the sleeve 90 and spacer discs or rings 96 which engage the actuator hub end wall 62. When the actuator hub 30 is advanced toward the main brake 32, it applies an axial compression force against the main disc stack 46 through the actuator hub end wall 62, the spacer discs 96, the actuator disc stack 74, and the actuator sleeve 90 to compress the main disc stack 46 against the outer hub end wall 40. It should be noted that both the main disc stack 46 and the actuator disc stack 74 are compressed, such that the actuator disc stack 74 functions as an assist brake section to retard rotation of the shaft 15. When the actuator hub 30 is axially retracted from the main disc stack 46, fluid shear between adjacent sets of fixed and rotary discs 42, 44, 64 and 66 causes the discs to expand from one another to minimize the fluid shear therebetween, thereby minimizing resistance to rotation of the shaft 15 in the lift direction.

Rotation of the shaft 15 in the lowering direction creates fluid shear within the actuator disc stack 74 which urges the actuator hub 30 to rotate in the lowering direction, and axially advancing the actuator hub 30 toward the main disc stack 46, compressing it and the actuator disc stack 74 by the action of the actuator sleeve 90. As the actuator hub 30 is axially forced toward the main disc stack 46, a condition of equilibrium is established between the torque applied to the shaft 15 through the cable drum 5 by the weight of the load 3 and the fluid shear generated in the actuator disc stack 74. At this equilibrium, rotation of the actuator hub 30 ceases.

Rotation of the shaft 15 in the lift direction generates fluid shear within the actuator disc stack 74 in the lift direction, thereby urging the actuator hub 30 to rotate in the lift direction and axially retracting the actuator hub 30 from the main disc stack 46. As the actuator hub 30 retracts, fixed and rotary discs in the main disc stack 46 and the actuator disc stack 74 expand under the influence of fluid shear generated between adjacent, relatively rotating discs. Rotation of the actuator hub 30 in the lift direction and axial retraction from the outer hub 28 continues until a condition of equilibrium between diminished fluid shear and the low friction of the bearings 86 is established.

At any point of lifting or lowering a load 3 using the hoist equipment 2, it may be necessary for the operator to stop the operation and hold the load 3 stationary. For this purpose, the hoist brake mechanism 1 is provided with a brake operator lever 100 which can be selectively operated to rotate the actuator hub 30 and cause a braking effect on the shaft 15. Angular movement of the lever 100 in the lowering direction of the shaft 15 rotates the actuator hub 30 in the lowering direction and axially advances the actuator hub 30 into the outer hub 28 to compress or further compress the main disc stack 46 and the actuator disc stack 74. Angular movement of the lever 100 in the opposite lift direction retracts the actuator hub 30 from the outer hub 28, releasing or reducing the braking effect of the disc stacks 46 and 74. The lever 100 can be utilized by direct manual operation, or by indirect operation through a mechanical linkage (not shown). It is also foreseen that the lever 100 could be operate remotely by electric, hydraulic, pneumatic, or other means.

Over time, operation of the hoist brake mechanism 1 resulting in surface engagement of the discs 42, 44, 64, and 66 frictionally wears the discs, thereby reducing their thickness. Because of this, the actuator hub 30 has to be turned farther and farther to cause a braking effect. As long as the discs remain thick enough to avoid structural failure during braking, this is not a problem internally. However, it can change the angular position of the brake operator lever 100. In order to allow recalibration of the angular position of the lever 100 with respect to the actuator hub 30, an embodiment of the mechanism 1 is provided with an angular adjustment assembly 104 (FIG. 7). As illustrated, a spur gear 106 is secured to the end wall 62 of the actuator hub 30, and a worm member or worm 108 is rotatably mounted on the lever 100. Rotation of the worm member 108 enables fine adjustment of the angular position of the lever 100 with respect to the end wall 62.

As stated previously, the braking effect of the main disc stack 46 and the actuator disc stack 74 can be varied by the number of discs employed in each stack. The illustrated embodiment of the hoist brake mechanism 1 is particularly suited to varying the number of sets of fixed and rotary discs. The spacer discs 96 (FIGS. 3, 4*b*, and 5) can be added to or removed to compensate for the removal or addition of sets of discs 42, 44, 64, and 66. The capability of varying the number of braking discs in the mechanism 1 allows an optimum number to be used for the maximum load 3 which a given mechanism 1 will be used to manipulate.

Referring to FIG. 1, the illustrated hoist equipment 2 incorporating the fluid shear actuated hoist brake mechanism 1 includes a well service truck 112 on which a double set of hoist drums 5 are mounted. The hoist drums 5 are mounted on the hoist framework 4 which is positioned on a bed of the truck 112 for cooperation with a lift boom 114. The drums 5 are rotated by a motor or motors and transmissions (not shown), which engage the sprockets 21 to rotate the shafts 15 of the drums 5. The illustrated truck 112 is of a type which is used for servicing oil wells. While the fluid shear actuated hoist brake mechanism is shown in the environment of a well service truck 112, it is not intended to be restricted to such an application. The mechanism 1 is applicable to a variety of types of hoist equipment, such as various types of cranes, lift booms, and the like.

It is to be understood that while certain forms of the present invention have been described and illustrated herein, it is not to be limited to the specific forms or arrangement of parts described and shown.

What is claimed and desired to be secured by Letters Patent is:

1. A hoist brake mechanism for a hoist including a hoist shaft rotationally mounted on a hoist frame to lift a load on a cable by rotation of the shaft in a lift direction or to lower said load in an opposite lowering direction of shaft rotation, said mechanism comprising:

(a) an outer hub fixed to said hoist frame in surrounding relation to said shaft;

(b) a main brake positioned within said outer hub and engaged between said outer hub and said shaft, said main brake including main brake members which retard rotation of said shaft upon axial engagement of said main brake members and which enable substantially free rotation of said shaft upon axial disengagement of said main brake members;

(c) an actuator hub helically engaged with said outer hub in such a manner as to axially advance toward said main brake to cause said axial engagement of said main brake members upon rotation of said actuator hub in said lowering direction of said shaft and to axially retract from said main brake upon rotation of said actuator hub in said lift direction to cause axial disengagement of said main brake members;

(d) a fluid shear actuator assembly engaged between said actuator hub and said shaft in such a manner that fluid shear caused by rotation of said shaft in said lowering direction urges said actuator hub to rotate in said lowering direction and fluid shear caused by rotation of said shaft in said lift direction urges said actuator hub to rotate in said lift direction; and (e) a liquid fluid positioned within said fluid shear actuator assembly and generating said fluid shear therein in response to rotation of said shaft.

2. A mechanism as set forth in claim 1 wherein said fluid shear actuator assembly includes:

(a) an actuator disc stack including a plurality of interleaved fixed actuator discs and rotary actuator discs, said fixed actuator discs being rotationally fixed with respect to said actuator hub and said rotary actuator discs rotating with said shaft; and (b) said actuator disc stack being immersed within said liquid fluid whereby relative movement of said rotary actuator discs with respect to said fixed actuator discs generates said fluid shear.

3. A mechanism as set forth in claim 1 wherein said fluid shear actuator assembly includes:

(a) a plurality of fixed actuator discs slidably engaged with said actuator hub to enable axial movement with respect to said actuator hub, said fixed actuator discs being rotationally fixed with respect to said actuator hub;

(b) a plurality of rotary actuator discs interleaved among said fixed actuator discs and slidably engaged with an inner hub in such a manner as to rotate with said shaft and to be axially slidable with respect to said shaft; and (c) said fixed actuator discs and said rotary actuator discs being immersed within said liquid fluid whereby relative movement of said rotary actuator discs with respect to said fixed actuator discs generates said fluid shear.

4. A mechanism as set forth in claim 1 wherein said main brake includes:

(a) an axially compressible main disc stack including as main brake members a plurality of interleaved fixed main discs and rotary main discs, said fixed main discs being rotationally fixed with respect to said outer hub and said rotary main discs rotating with said shaft; and (b) said fixed and rotary main discs cooperating whereby axial compression of said main disc stack retards rotation of said shaft and axial expansion of said main disc stack enables said substantially free rotation of said shaft.

5. A mechanism as set forth in claim 4 and including:

(a) said main brake stack having said liquid fluid in which said fixed and rotary main discs are immersed.

6. A mechanism as set forth in claim 1 wherein said main brake is a main brake stack and said brake members include:

(a) a plurality of fixed main discs engaging said outer hub in such a manner as to enable axial movement relative to said shaft and to prevent rotational movement relative to said outer hub;

(b) a plurality of rotary main discs interleaved among said fixed main discs and slidably engaged with an inner hub in such a manner as to rotate with said shaft, said rotary main discs cooperating with said fixed main discs to form a main disc stack; and (c) said fixed main discs and said rotary main discs cooperating such that axial compression of said main brake stack retards rotation of said shaft and axial expansion of said main brake stack enables said substantially free rotation of said shaft.

7. A mechanism as set forth in claim 1 wherein:

(a) said fluid shear actuator assembly includes:

(1) an actuator disc stack including a plurality of interleaved fixed actuator discs and rotary actuator discs, said fixed actuator discs being rotationally fixed with respect to said actuator hub and said rotary actuator discs rotating with said shaft; and (2) said actuator disc stack being immersed within said liquid fluid whereby relative movement of said rotary actuator discs with respect to said fixed actuator discs generates said fluid shear;

(b) said main brake includes:

(1) an axially compressible main disc stack including as main brake members a plurality of interleaved fixed main discs and rotary main discs, said fixed main discs being rotationally fixed with respect to said outer hub and said rotary main discs rotating with said shaft; and (2) said fixed and rotary main discs cooperating whereby axial compression of said main disc stack retards rotation of said shaft and axial expansion of said main disc stack enables said substantially free rotation of said shaft;

(c) an actuator sleeve slidably positioned on an inner hub to enable selective axial engagement of a main end of said actuator sleeve with said main disc stack and having an opposite actuator end axially engaging said actuator disc stack; and (d) said actuator sleeve cooperating with said actuator hub in such a manner that axial advancement of said actuator hub toward said main brake causes axial compression of said main disc stack and said actuator disc stack and axial retraction of said actuator hub from said main brake enables axial expansion of said main disc stack and said actuator disc stack.

8. A mechanism as set forth in claim 7 and including:

(a) one or more spacer discs positioned within said mechanism, said spacer discs cooperating with said main discs and said actuator discs to enable adjustment of the number of said main discs and/or said actuator discs by compensatory addition and/or reduction in the number of spacer discs positioned within said mechanism.

9. A mechanism as set forth in claim 1 and including:

(a) an outer helical bearing groove formed on an inner surface of said outer hub;

(b) an inner helical bearing groove formed on an outer surface of said actuator hub, said inner groove being axially aligned with said outer groove to form a helical track; and (c) a plurality of bearings positioned within said helical track to helically engage said actuator hub with said outer hub.

10. A mechanism as set forth in claim 9 and including:

(a) a bearing return passage communicating with one end of said helical track and an opposite end of said helical track; and (b) said bearing return passage forming a part of said helical track and cooperating with said bearings to recirculate said bearings through said helical track in response to rotation of said actuator hub relative to said outer hub.

11. A mechanism as set forth in claim 1 and including:

(a) a manually operated lever engaged with said actuator hub to enable manual rotation of said actuator hub to selectively axially advance said actuator hub toward said main brake or to axially retract said actuator hub from said main brake.

12. A mechanism as set forth in claim 11 and including:

(a) said lever being engaged with said actuator hub in such a manner as to enable angular adjustment of said lever with respect to said actuator hub.

13. A hoist brake mechanism for a hoist including a cable drum secured to a hoist shaft rotationally mounted on a hoist frame and having a hoist cable wound thereon to lift a load by rotation of the shaft in a lift direction or to lower said load in an opposite lowering direction of shaft rotation, said mechanism comprising:

(a) an outer hub fixed to said hoist frame in surrounding relation to a brake section of said shaft;

(b) an axially compressible main disc stack including a plurality of interleaved fixed main discs and rotary main discs, said fixed discs being rotationally fixed with respect to said outer hub and said rotary discs rotating with said shaft; axial compression of said main disc stack retarding rotation of said shaft and axial expansion of said main disc stack enabling substantially free rotation of said shaft;

(c) an actuator hub helically engaged with said outer hub in such a manner as to axially advance toward said main disc stack to cause axial compression thereof upon rotating in said lowering direction of said shaft and to axially retract from said main disc stack to enable axial expansion thereof upon rotating in said lift direction;

(d) an actuator disc stack positioned within said actuator hub and including a plurality of interleaved fixed actuator discs and rotary actuator discs, said fixed actuator discs being rotationally fixed with respect to said actuator hub, and said rotary actuator discs rotating with said shaft; and (e) a liquid fluid surrounding said actuator disc stack whereby fluid shear generated among said fixed and rotary actuator discs when said shaft rotates in said lowering direction urges said actuator hub to axially advance toward said main disc stack and whereby fluid shear generated within said actuator disc stack by rotation of said shaft in said lift direction urges said actuator hub to axially retract from said main disc stack.

14. A mechanism as set forth in claim 13 and including:

(a) said main brake stack having said liquid fluid in which said fixed and rotary main discs are immersed.

15. A mechanism as set forth in claim 13 and including:

(a) an actuator sleeve slidably positioned on an inner hub to enable selective axial engagement of a main end of said actuator sleeve with said main disc stack and having an opposite actuator end axially engaging said actuator disc stack; and (b) said actuator sleeve cooperating with said actuator hub in such a manner that axial advancement of said actuator hub toward said main brake causes axial compression of said main disc stack and said actuator disc stack and axial retraction of said actuator hub from said main brake enables axial expansion of said main disc stack and said actuator disc stack.

16. A mechanism as set forth in claim 13 and including:

(a) one or more spacer discs positioned within said mechanism, said spacer discs cooperating with said main discs and said actuator discs to enable adjustment of the number of said main discs and/or said actuator discs by compensatory addition and/or reduction in the number of spacer discs positioned within said mechanism.

17. A mechanism as set forth in claim 13 and including:

(a) an outer helical bearing groove formed on an inner surface of said outer hub;

(b) an inner helical bearing groove formed on an outer surface of said actuator hub, said inner groove being axially aligned with said outer groove to form a helical track; and (c) a plurality of bearings positioned within said helical track to helically engage said actuator hub with said outer hub.

18. A mechanism as set forth in claim 17 and including:

(a) a bearing return passage communicating with one end of said outer helical bearing groove and an opposite end of said outer helical bearing groove; and (b) said bearing return passage forming a part of said helical track and cooperating with said bearings to recirculate said bearings through said helical track in response to rotation of said actuator hub relative to said outer hub.

19. A mechanism as set forth in claim 13 and including:

(a) a manually operated lever engaged with said actuator hub to enable manual rotation of said actuator hub to selectively axially advance said actuator hub toward said main brake or to axially retract said actuator hub from said main brake.

20. A mechanism as set forth in claim 19 and including:

(a) said lever being engaged with said actuator hub by a worm and pinion to enable angular adjustment of said lever with respect to said actuator hub.

21. A mechanism as set forth in claim 13 and including:

(a) one or more spacer discs positioned within said actuator hub, said spacer discs cooperating with said main discs and said actuator discs to enable adjustment of the number of said main discs and/or said actuator discs by compensatory addition and/or reduction in the number of spacer discs positioned within said actuator hub.

22. A hoist brake mechanism for a hoist including a cable drum secured to a shaft rotationally mounted on a hoist frame and having a hoist cable wound thereon to lift a load by rotation of the shaft in a lift direction or to lower said load in an opposite lowering direction of shaft rotation, said mechanism comprising:

(a) an outer hub fixed to said hoist frame in surrounding relation to a brake section of said shaft;

(b) an inner hub secured to said shaft coaxially within said outer hub and rotating with said shaft;

(c) a plurality of fixed main discs engaging said outer hub in such a manner as to enable axial movement relative to said shaft and to prevent rotational movement relative to said outer hub;

(d) a plurality of rotary main discs interleaved among said fixed main discs and axially slidably engaged with said inner hub in such a manner as to rotate with said shaft;

(e) said rotary main discs cooperating with said fixed main discs to form a main disc stack, axial compression of said main disc stack retarding rotation of said shaft and axial expansion of said main disc stack enabling substantially free rotation of said shaft;

(f) an actuator sleeve slidably positioned on said inner hub to enable selective axial engagement of a main end thereof with said main disc stack and having an opposite actuator end;

(g) an actuator hub helically engaged with said outer hub and cooperating with said actuator sleeve in such a manner as to axially advance said actuator sleeve toward said main disc stack to axially compress said main disc stack upon rotation of said actuator hub in said lowering direction of said shaft and to enable axial retraction of said actuator sleeve from said main disc stack to enable axial expansion thereof upon rotation of said actuator hub in said lift direction;

(h) a plurality of fixed actuator discs axially slidably engaged with said actuator hub, said fixed actuator discs being rotationally fixed with respect to said actuator hub;

(i) a plurality of rotary actuator discs interleaved among said fixed actuator discs and axially slidably engaged with said inner hub in such a manner as to rotate with said shaft, said rotary actuator discs cooperating with said fixed actuator discs to form an actuator disc stack; and (j) a liquid fluid surrounding at least said actuator disc stack whereby fluid shear generated between respective adjacent sets of said fixed and rotary actuator discs when said shaft rotates in said lowering direction urges said actuator hub to axially advance said actuator sleeve toward said main disc stack and whereby fluid shear generated within said actuator disc stack by rotation of said shaft in said lift direction urges said actuator hub to axially retract from said actuator sleeve thereby enabling expansion of said main disc stack.

23. A mechanism as set forth in claim 22 and including:

(a) said main brake stack having said liquid fluid in which said fixed and rotary main discs are immersed.

24. A mechanism as set forth in claim 22 and including:

(a) an outer helical bearing groove formed on an inner surface of said outer hub;

(b) an inner helical bearing groove formed on an outer surface of said actuator hub, said inner groove being axially aligned with said outer groove to form a helical track; and (c) a plurality of bearings positioned within said helical track to helically engage said actuator hub with said outer hub.

25. A mechanism as set forth in claim 24 and including:

(a) a bearing return passage communicating with one end of said outer helical bearing groove and an opposite end of said outer helical bearing groove; and (b) said bearing return passage forming a part of said helical track and cooperating with said bearings to recirculate said bearings through said helical track in response to rotation of said actuator hub relative to said outer hub.

26. A mechanism as set forth in claim 22 and including:

(a) a manually operated lever engaged with said actuator hub to enable manual rotation of said actuator hub to selectively axially advance said actuator hub toward said main brake or to axially retract said actuator hub from said main brake.

27. A mechanism as set forth in claim 26 and including:

(a) said lever being engaged with said actuator hub by a worm and pinion to enable angular adjustment of said lever with respect to said actuator hub.

* * * * *